United States Patent [19]

Wenzel et al.

[11] Patent Number: 4,524,652

[45] Date of Patent: Jun. 25, 1985

[54] RATCHET WRENCH OF THE SOCKET DRIVE TYPE WITH SOCKET EJECTOR

[75] Inventors: Kenneth G. Wenzel, Highland Village; Jerry R. Duke, Redoak, both of Tex.

[73] Assignee: Thorsen Tool Company, Dallas, Tex.

[21] Appl. No.: 608,470

[22] Filed: May 9, 1984

Related U.S. Application Data

[63] Continuation of Ser. No. 551,425, Nov. 14, 1983, abandoned.

[51] Int. Cl.[3] ..... B25B 13/46

[52] U.S. Cl. ..... 81/63; 81/177 G

[58] Field of Search ..... 81/60–63, 81/177 G; 192/43.1

[56] References Cited

U.S. PATENT DOCUMENTS 4,307,632 12/1981 Penner ..... 81/63

*Primary Examiner*—James L. Jones, Jr.

*Attorney, Agent, or Firm*—Wm. T. Wofford; James C. Fails; Arthur F. Zobal

[57] ABSTRACT

Ratchet wrenches of the socket drive type with socket ejector incorporate improved structure and arrangement involving the control knob stub shaft portion, the ejector pin retainer plate, and assembly technique.

2 Claims, 5 Drawing Figures

RATCHET WRENCH OF THE SOCKET DRIVE TYPE WITH SOCKET EJECTOR

This application is a continuation of application Ser. No. 551,425, filed Nov. 14, 1983 now abandoned.

FIELD OF INVENTION

The invention relates to ratchet wrenches and more particularly to improved ratchet wrenches of the socket drive type that incorporates socket ejector means.

DESCRIPTION OF THE PRIOR ART

One of the most common types of mechanic's wrenches currently in use is the socket with a ratchet drive. The ratchet drive accommodates a number of sockets having a range of sizes to make up a set. A selected socket is received on a drive stud and is normally retained thereon by means of a detent device. Some ratchet drives of the prior art of which I am aware, as exemplified by U.S. Pat. Nos. 3,393,587, 3,815,451 and 3,881,376, incorporate socket ejector means, so that sockets can be removed from the drive stud by depressing an ejector control. Improved ratchet drives of the type that incorporate socket ejector means are disclosed by U.S. continuation patent application Ser. No. 619,816 filed June 12, 1984, inventor James W. Konecny.

The general object of the present invention is to provide ratchet drives that incorporate improvements over those that are disclosed by the above-mentioned pending application.

More specifically, it is an object of the present invention to improve the structure of the ratchet drive control knob and ejector pin retainer plate.

Another object of the present invention is to improve the ratchet plug assembly arrangement so as to facilitate its assembly.

For a further understanding of the invention and further objects, features, and advantages thereof, reference may now be had to the following description, taken in conjunction with the accompanying drawings.

DESCRIPTION OF PREFERRED EMBODIMENT

Figure 1:
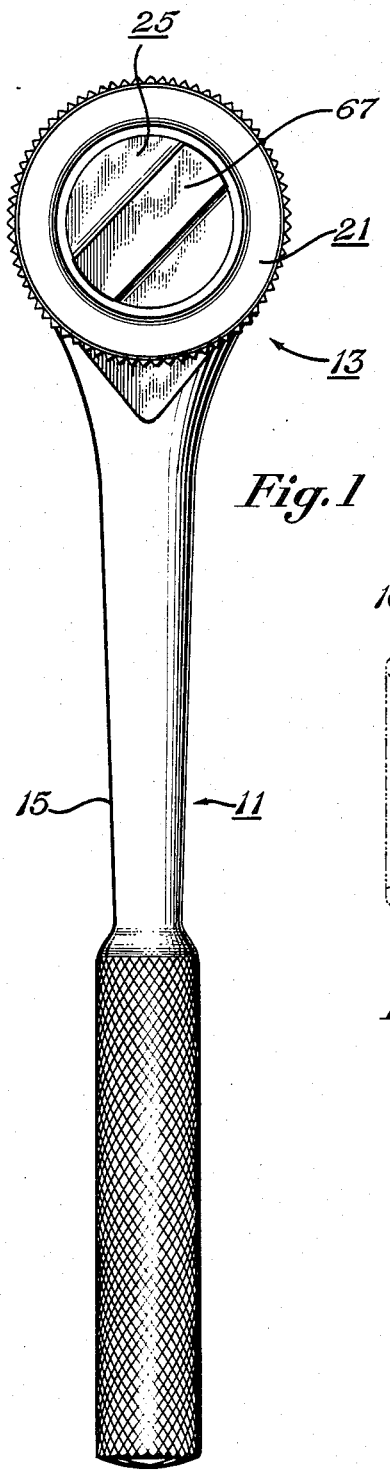
FIG. 1 is a top plan view of a typical ratchet wrench with socket drive and incorporating socket ejector means, in accordance with a preferred embodiment of the invention.
Figure 2:
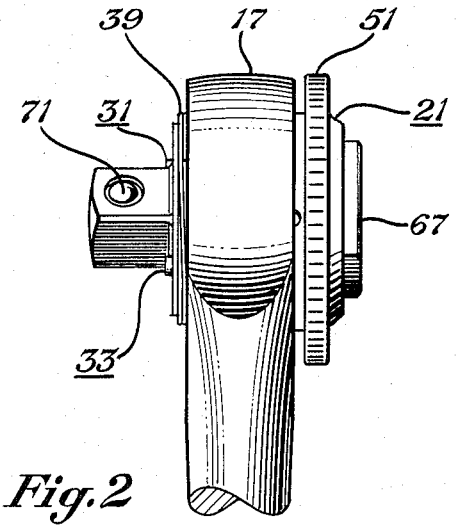
FIG. 2 a side elevational view of the ratchet wrench of FIG. 1, without a socket installed and with a portion of the handle removed.

For convenience, a ratchet wrench with socket drive which incorporates improvements in accordance with a preferred embodiment of the invention will first be described and then the improvements will be discussed.

Referring now to the drawings it can be seen that the ratchet drive is made up of a handle 11 and a ratchet plug assembly 13. The handle 11 has a lever portion 15 which is integrally merged with a cylindrical head portion 17. The cylindrical head portion 17 has a central bore with spline-like teeth 19 formed therein.

The ratchet plug assembly 13 (see FIGS. 3 and 4) includes ratchet plug 21, ratchet pawl 23, ratchet pawl pivot pin 24, control knob 25, ratchet reversing pin 27, reversing pin bias spring 29, first socket ejector pin 31, second socket ejector pin 33, ejector pin retainer plate 35, control knob return conical spring 37 and ratchet plug assembly retainer ring 39. The ratchet plug 21 comprises a generally cylindrical body portion 41 and a drive stud portion 43. The cylindrical body portion 41 comprises a cylindrical exterior portion 45, a retainer ring groove 47, a bearing shoulder 49, a spinner control flange 51, a control knob recess 53, a control knob bore 55, a ratchet pawl slot 57, first and second ejector pin bores 59, 61, and a drive stud end surface 62.

The cylindrical exterior portion 45 has a diameter that is slightly less than the minor diameter of the spline-like teeth 19 of the handle head portion 17 and a length that is substantially equal to that of the spline-teeth 19. The cylindrical exterior portion 45 merges at one end with the retainer ring groove 47 and at the other end with the bearing shoulder 49 which in turn merges with the spinner control flange 51. The ratchet pawl slot 57 has parallel side faces that are spaced a distance slightly greater than the width of the ratchet pawl 23 and bottom surfaces that lie in a plane parallel to and passing near the central axis of the ratchet plug 21. The ratchet pawl slot 57 is closely adjacent the retainer ring groove 47, which in turn is closely adjacent the body portion drive stud end surface 62. The end surface 62 is generally planar and is perpendicular to the ratchet plug central axis.

The control knob has a head portion 63 and a stub shaft portion 65. The head portion 63 has the shape of a disc, the top surface of which merges with an integral generally rectangular boss 67. The stub shaft portion 65 is cylindrical and is coaxial with the head portion 63.

The control knob recess 53 is cylindrical; is coaxial with the ratchet plug 21; has a diameter slightly greater than that of the control knob head portion 63; and has a planar bottom surface 69 that is perpendicular to the ratchet plug central axis. The control knob bore 55 is cylindrical; is coaxial with the ratchet plug 21; has a diameter slightly greater than that of the control knob stub shaft portion 65; and merges at its open end with the control knob recess bottom surface 69. The first and second ejector pin bores 59, 61 are cylindrical; have the same diameters, which are slightly greater than those of the ejector pins 31, 33; are disposed on opposite sides of the control knob bore 55; have their axes parallel to that of the control knob bore 55; open at one end to the control knob recess bottom surface 69 and at the other end to the drive stud end surface 62 of the cylindrical body portion 41. A plane containing the axes of the ejector pin bores 59, 61 is parallel to a plane containing the bottom surfaces of the ratchet pawl slot 57.

The drive stud portion 43 of the ratchet plug 21 is integral with the cylindrical body portion 41; extends outwardly from the drive stud end surface 62; is coaxial with the ratchet plug 21; has the conventional generally square transverse section shape; is dimensioned to receive the sockets of a set having the corresponding drive size; and is provided with the conventional detent ball 71 and spring (not shown).

The ratchet pawl 23 has a generally arcuate outer surface having a set of axially extending spline-like teeth 73, 74 at each end portion thereof; an inner surface having an axially extending center notch portion 75 with a respective planar portion 77, 79 extending outwardly from each side of the notch portion; a rocker bore 81 extending axially of the ratchet pawl 23 and opening to respective parallel planar pawl side faces 83, 85 with the rocker bore axis being parallel to said spline-like teeth 73, 74 and lying in a plane that bisects the ratchet pawl 23.

The first and second ejector pins 31, 33 are alike and each have a cylindrical exterior surface portion 87 and an annular groove 88 adjacent a head portion 89. The ejector pin retainer plate 35 has a circular peripheral shape, with a pair of oppositely disposed side slots 91 and a central opening 93.

To assemble the ratchet plug assembly 13, the ratchet pawl 23 is positioned in the ratchet pawl slot 57 with its center notch portion 75 facing inwardly and the ratchet pawl pivot pin 24 is inserted and positioned within first and An assembly access opening 106 is provided that communicates between the interior of the control knob recess 53 adjacent its bottom surface 69 and the exterior of the ratchet plug 21. The central axis of the assembly access opening 106 is perpendicular to and intersects the central axis of the ratchet plug 21 and is perpendicular to and intersects the central axis of the aligned bearing bores 102, 104. Consequently, the assembly access opening is also substantially aligned with the central axis of the ratchet reversing pin 27 at its present stage of assembly. Next, the ratchet reversing pin 27 is depressed sufficiently, by means of a suitable tool (not shown) inserted in the assembly access opening 106, to permit its entry into the control knob bore 55, at which time the small end of the conical spring 37 will bear on the bottom surface 69 of the control knob recess 53.

Figure 5:
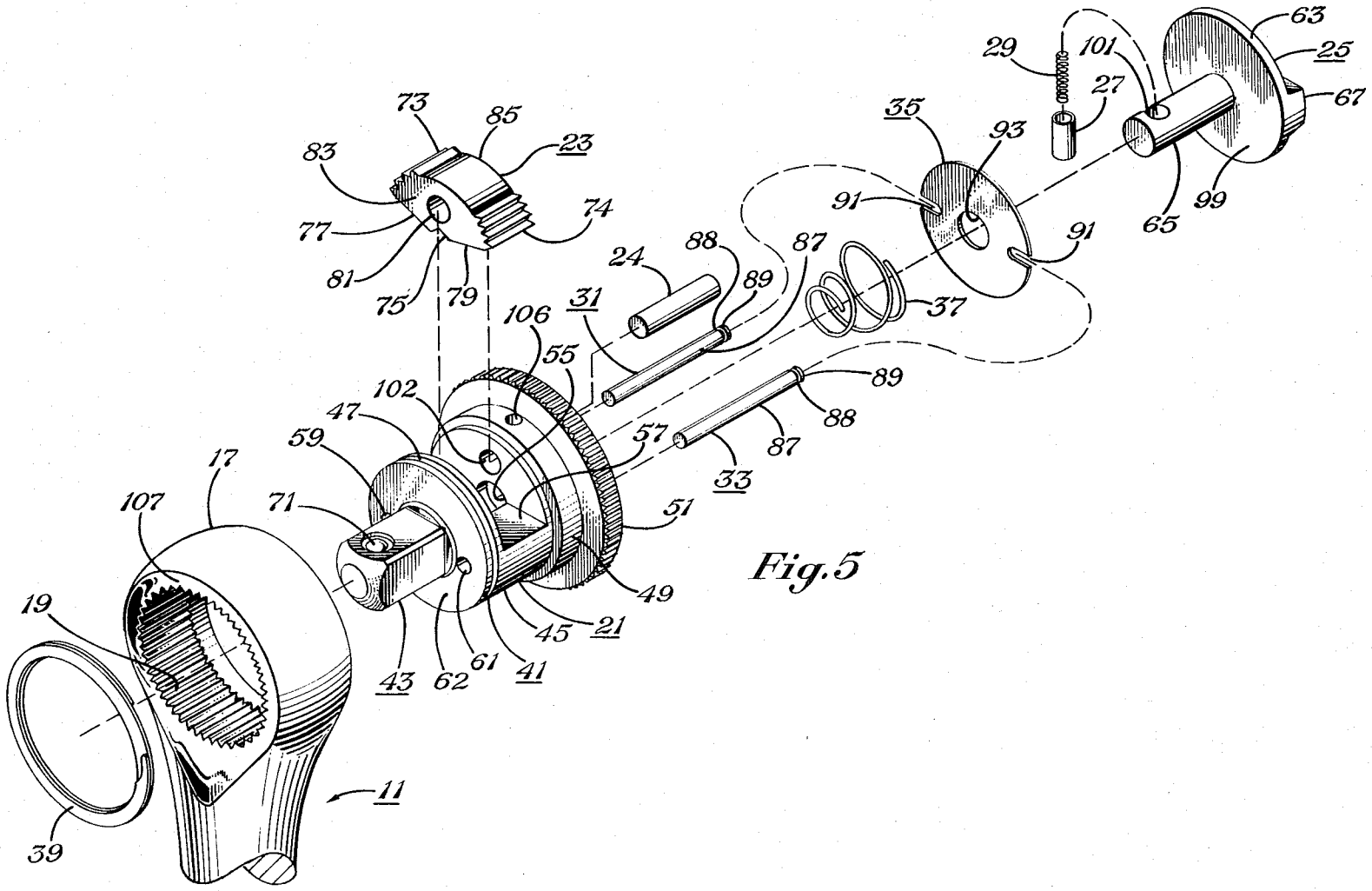
FIG. 5 is an exploded perspective view of the ratchet drive assembly.

A plane containing the bottom surfaces of the ratchet pawl slot 57 will intersect the control knob bore 55 (see FIG. 5) to form a rectangular opening that will be disposed opposite the ratchet pawl center notch portion 75. Thus, when the control knob stub shaft portion 65 has been moved a sufficient distance into the control knob bore 55, the reversing pin 27 will enter the above-mentioned rectangular opening at which time it will be extended by the force of its bias spring 29 to bear against the ratchet pawl underside or notch portion 75. When pressure on the control knob 25 is released the return conical spring 37 will move the control knob outwardly until the ratchet reversing pin abuts a side face of the ratchet pawl slot 57, at which time the outer surface of the control knob head 63 is substantially flush with the outer extremity of the control knob recess 53.

To assemble the ratchet plug assembly 13 onto the handle 11, the ratchet plug cylindrical exterior portion 45 is inserted into the bore of the handle cylindrical head portion 17 until the bearing shoulder 49 abuts a shoulder 105 of the handle cylindrical head portion 17, at which time the retainer ring groove 47 will extend outwardly just beyond the side face 107 of the handle cylindrical head portion 17. The ratchet plug assembly retainer ring 39 is then installed in the retainer ring groove 47. The ratchet retainer ring may be a conventional commercially available type made of spring strip material formed to have the shape of a circular flat spiral, as shown. The retainer ring 39 can be expanded radially to increase its inner diameter sufficiently to pass over the periphery of the ratchet plug end surface 62 and then will relax so that its inner diameter will substantially conform to the bottom of the retainer ring groove 47. When the retainer ring 39 is installed, its inner side surface will bear against the adjacent side face 107 of the handle cylindrical head portion 17 so as to substantially prevent axial movement of the ratchet plug assembly 13. When inserting the ratchet plug assembly 13 into the bore of the handle cylindrical head portion 17 it is necessary to rock the ratchet pawl 23 slightly in a direction to compress the ratchet reverse pin bias spring 29, which then permits the teeth 73, 74 of the pawl 23 to pass into the bore of the handle cylindrical head portion 17. When installing pressure on the pawl 23 is released, the bias spring 29 acting on the ratchet reversing pin 27 will rock the ratchet pawl 23 so that its respective teeth 73 or 74 are in proper engagement with the spline-like teeth 19 of the handle cylindrical head portion 17.

Figure 3:
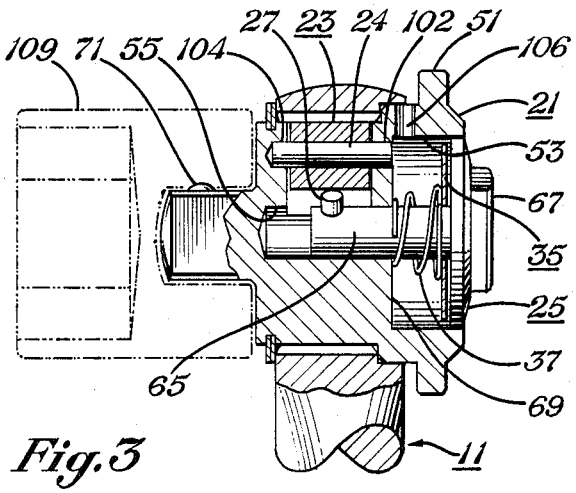
FIG. 3 is a side elevation view, partly in section and partly cut away, showing the interior of the drive assembly of the ratchet wrench of FIG. 2, with a socket ejector in the retracted position and with a socket (shown in phantom) in working position on the drive stud.
Figure 4:
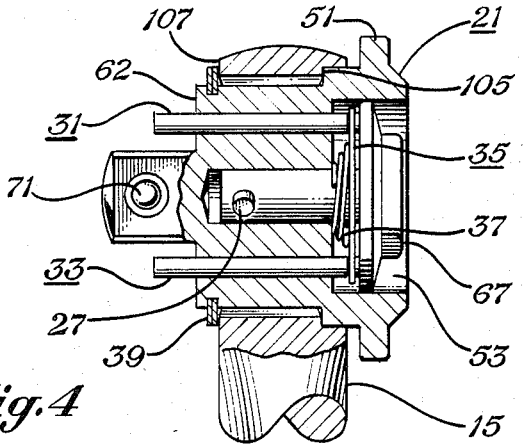
FIG. 4 is like FIG. 3, but with the section being taken in a plane normal to the plane of the FIG. 3 section and with the socket ejector in the extended or ejecting position (the socket has been ejected).

In operation, a socket 109 (shown in phantom in FIG. 3) is installed on the drive stud portion 43 and is held in place in a conventional manner by action of the detent ball 71. The control knob 25 is then in the ejector pin retracted position and the ratchet pawl 23 (as shown by FIG. 3) is in the drive clockwise and ratchet counter clockwise position. To drive counter clockwise and ratchet clockwise the control knob 25 is simply rotated to its extreme clockwise position, causing the ratchet reverse pin 27 to shift its position on the inner surface of the ratchet pawl 23 so as to pivot the ratchet pawl on the ratchet pawl pivot pin 24 so as to disengage one set of pawl teeth 74 and engage the other set 73. To eject the socket 109, the control knob 25 is depressed to the ejector pin extended position (see FIG. 4) and the socket 109 is pushed by the ejector pins 31, 33 out of engagement with the detent ball 71 and off the end of the drive stud 43.

As stated hereinabove, ratchet drives of the present invention incorporate improvements over those disclosed by the named pending application. These improvements will now be discussed.

In the pending application, the control knob stub shaft portion was provided a peripheral groove at its inner end and the retainer plate was provided a side slot to be conformingly received by the peripheral groove. In accordance with the present invention the control knob stub shaft portion peripheral groove is eliminated and the retainer plate side slot is replaced by a central opening 93. The elimination of the peripheral groove reduces manufacturing cost and increases the strength of the control knob stub shaft portion 65. The provision of the retainer plate central opening 93 accommodates the absence of the peripheral groove and also permits a more positive positioning of the ejector pins 31, 33.

In the pending application, the control knob return conical spring was assembled with its smaller end facing the inner face 99 of the control knob head portion 63. In accordance with the present invention the control knob conical spring 37 is assembled with its larger end facing the inner face 99 of the control knob head portion 63. This makes it possible to pre-assemble the control knob 25, retainer plate 35, ejector pins 31, 33, ratchet reversing pin 27 and its bias spring 29, and the control knob conical spring 37, in the manner hereinabove described, thus significantly facilitating the overall assembly operation. The foregoing disclosure and the showings made in the drawings are merely illustrative of the principles of this invention and are not to be interpreted in a limiting sense.

We claim:

1. A ratchet wrench of the socket drive type with socket ejector comprising:

a. a handle having a lever portion and a head portion, with the head portion having a central bore with internal spline-like teeth formed therein and oppositely disposed side faces;

b. a ratchet plug assembly installed in the head portion of said handle and including:

i. a ratchet plug with a body portion having a drive stud end surface and having an integral socket drive stud protruding axially outwards from said drive stud end surface, an axial cylindrical recess having a bottom surface and opening to the body portion end opposite said socket drive stud, and a pair of spaced parallel ejector pin bores extending through said body portion and adjacent to respective side margins of said socket drive stud and opening to said axial cylindrical recess and a control knob bore coaxial with said axial cylindrical recess and extending from said axial cylindrical recess bottom surface in the direction toward said socket drive stud and having a bottom surface that is disposed axially inward with respect to said drive stud end surface;

ii. ratchet pawl means for driving or ratcheting on said spline-like teeth and reversing means therefor;

iii. a control knob for controlling both ratchet drive direction selection and socket ejection disposed in said axial cylindrical recess for reciprocable movement therein, with said control knob having a head portion which has an inner face and a cylindrical stub shaft portion having a constant diameter extending axially inward from said inner face with the diameter of said head portion being slightly less than the diameter of said axial cylindrical recess;

iv. an ejector pin retainer plate disposed on said stub shaft adjacent said inner face and having oppositely disposed side slots;

v. a pair of ejector pins each having an annular groove adjacent one end thereof with a respective annular groove being disposed within a respective said retainer plate side slot with said ejector pins being inserted in said ejector pin bores; and, vi. a conical type control knob return spring having a larger diameter that is smaller than the transverse extent of said retainer plate and having a smaller diameter that is slightly larger than the diameter of said control knob stub shaft portion, with said control knob return spring being disposed between said cylindrical recess bottom surface and said ejector pin retainer plate, with the larger end of said spring facing said inner face of said control knob head portion, and;

vii. a ratchet reversing pin and a ratchet reversing pin bias spring, with said control knob stub shaft portion having a transverse recess disposed near said inward end for receiving said ratchet reversing pin and bias spring, such that said ratchet reversing pin may project from said recess to retain a sub-assembly comprising said retainer plate, ejector pins and control knob return spring when said wrench is being assembled.

2. A ratchet wrench of the socket drive type with socket ejector comprising:

a. a handle having a lever portion and a head portion, with the head portion having a central bore with internal spline-like teeth formed therein and oppositely disposed side faces;

b. a ratchet plug assembly installed in the head portion of said handle and including:

i. a ratchet plug with a body portion having a drive stud end surface and having an integral socket drive stud protruding axially outwards from said drive stud end surface, an axial cylindrical recess opening to the body portion end opposite said socket drive stud, and a pair of spaced parallel ejector pin bores extending through said body portion and adjacent to respective side margins of said socket drive stud and opening to said axial cylindrical recess and a control knob bore coaxial with said axial cylindrical recess and extending from said axial cylindrical recess bottom surface in the direction toward said socket drive stud and having a bottom surface that is disposed axially inward with respect to said drive stud end surface;

ii. ratchet pawl means for driving or ratcheting on said spline-like teeth and reversing means therefor;

iii. a control knob for controlling both ratchet drive direction selection and socket ejection disposed in said axial cylindrical recess for reciprocable movement therein, with said control knob having a head portion which has an inner face and a cylindrical stub shaft portion having a constant diameter extending axially inward from said inner face with the diameter of said head portion being slightly less than the diameter of said axial cylindrical recess;

iv. an ejector pin retainer plate having a central opening sized to be matingly received by said stub shaft portion and having oppositely disposed side slots, with said retainer plate being disposed on said stub shaft portion adjacent said inner face, and, v. a pair of ejector pins each having an annular groove adjacent one end thereof with a respective annular groove being disposed within a respective said retainer plate side slot and with said ejector pins being inserted in said ejector pin bores, and;

vi. a conical type control knob return spring having a larger diameter that is smaller than the transverse extent of said retainer plate and having a smaller diameter that is slightly larger than the diameter of said control knob stub shaft portion, with said control knob return spring being disposed between said cylindrical recess and said ejector pin retainer plate.

* * * * *